US008006720B1

(12) United States Patent
Kotansky

(10) Patent No.: US 8,006,720 B1
(45) Date of Patent: Aug. 30, 2011

(54) DOWNSPOUT FLOW DIVERTER

(76) Inventor: Kenneth S. Kotansky, Gig Harbor, WA (US)

( * ) Notice: Subject to any disclaimer, the term of this patent is extended or adjusted under 35 U.S.C. 154(b) by 536 days.

(21) Appl. No.: 12/291,442

(22) Filed: Nov. 10, 2008

Related U.S. Application Data

(60) Provisional application No. 61/002,600, filed on Nov. 9, 2007.

(51) Int. Cl.
*E04D 13/08* (2006.01)

(52) U.S. Cl. ..... 137/873; 52/16

(58) Field of Classification Search ..... 137/873; 251/341; 52/16
See application file for complete search history.

(56) References Cited

U.S. PATENT DOCUMENTS

| | | | | |
|---|---|---|---|---|
| 60,005 | A | | 11/1866 | Hicks et al. |
| 96,478 | A | | 11/1869 | Perkins |
| 125,742 | A | | 4/1872 | Lee |
| 142,832 | A | | 9/1873 | Wuerz |
| 246,930 | A | | 9/1881 | West |
| 289,821 | A | | 12/1883 | Fisher |
| 458,768 | A | | 9/1891 | Weightman |
| 608,765 | A | | 8/1898 | Epple |
| 1,076,075 | A | | 10/1913 | Steele |
| 2,030,467 | A | * | 2/1936 | Pearce ..... 137/873 |
| 3,481,366 | A | | 12/1969 | Mortonson |
| 3,990,474 | A | | 11/1976 | Harms |
| 5,127,439 | A | * | 7/1992 | Stanchina ..... 137/872 |
| 5,230,798 | A | * | 7/1993 | Rogman ..... 210/447 |
| D354,552 | S | * | 1/1995 | Weber ..... D23/261 |
| 5,709,051 | A | * | 1/1998 | Mazziotti ..... 52/12 |
| 5,867,944 | A | * | 2/1999 | Attaway ..... 52/16 |
| 5,985,158 | A | | 11/1999 | Tiderington |
| 6,024,127 | A | | 2/2000 | Johnson |

OTHER PUBLICATIONS

Metal Rain Diverter (product sold in internet catalog by GREENCulture, Inc. Lake Forest, CA 92630) http://www.composters.com/rain-barrels/metal-rain-diverter_171_10.php.

* cited by examiner

*Primary Examiner* — John Fox

(57) ABSTRACT

A downspout flow diverter for diverting water from a gutter downspout to an alternate location outside the downspout. A first embodiment of the downspout flow diverter comprising a diverter plate pivotally supported from a main body, and a sliding jacket disposed for sliding engagement with the main body, wherein the position of the diverter plate is responsive to the position of the sliding jacket. The first embodiment of the downspout flow diverter further comprising a seepage barrier, defining a drain void, for channeling water seepage from around the stowed diverter plate, back into the main body.

20 Claims, 9 Drawing Sheets

DOWNSPOUT FLOW DIVERTER

CROSS-REFERENCE TO RELATED APPLICATIONS

This application claims the benefit of provisional patent application U.S. Ser. No. 61/002,600 filed 2007 Nov. 9 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates generally to the field of rain gutters and downspouts, and particularly to devices that divert the flow of water therefrom.

2. Prior Art

One of the simplest ways to clean gutters and downspouts is by spraying with water, such as that from a garden hose or pressure washer. When downspouts are connected to underground drainage lines, however, water cleansing may cause debris related obstructions in the underground lines. This is especially true when there are frequent bends, long runs, or minimal slopes in the underground pipes. For these reasons, the industry has not recommended liquid rinsing as a preferred method for cleaning downspouts that connect to underground lines.

Building owners and maintainers could benefit greatly from a device that would allow them to rinse gutters and downspouts without the risk of clogging underground lines.

Prior art from the late nineteenth century shows a related field of downspout diversion devices known as cistern cutoffs. In U.S. Pat. No. 60,005 (1866), Hicks and Welcker disclose a cistern cutoff consisting of;

> " . . . a square box . . . provided with an adjustable spout . . . which turns around a hinge . . . by whose means the water running from a roof, etc., of a building, towards a cistern or other receptacle of rainwater, can be turned off, or may be directed to flow into the cistern."

Hicks' design may be described as an "out-swing geometry" in that the disclosed "adjustable spout" rotates outwardly from a closed position, flush with the "square box," or main body, to an operable position, angularly extended across the width of and outward from the main body.

In such "out-swing geometry" devices, as the spout swings outward from above a hinge, a deflection surface, below the hinge, swings inward to redirect the flow of water. As the deflection surface rotates inward, it is required to rotate past 90° (horizontal) to some greater angle sufficient to re-direct water out of the main body. The length of the deflection surface is thus limited by the fact that in the horizontal position its length must allow it to clear the back wall of the main body. As rotation continues beyond horizontal, the end of the deflection surface is caused to pull away from the back wall of the main body. This pulling-away from the back wall results in a gap (herein after referred to as "plate gap") between the deflection surface and the back wall of the main body, which allows some of the water to escape past the deflection surface.

Hicks addressed the plate gap problem by means of,

> " . . . an extra leader [downspout section] . . . provided inside of the box . . . so excluding the possibility of any water running into the cistern as long as the spout . . . is kept open."

Hicks provided few details, however, as to the means or position of attachment for the "extra leader" with respect to the main body.

Several other examples of the prior art demonstrated various ways to overcome plate gap in in-swing type cistern cutoff devices.

Perkins, in U.S. Pat. No. 96,478 (1869), discloses a device where the pivot point of the plate is itself rotatable about a linkage attached to the main body. This rotating pivot point allows the deflection surface to translate inward into the main body as the surface is rotated outward.

Lee, in U.S. Pat. No. 125,742 (1872), discloses a device using an inner chamber or "sliding section" to eliminate the plate gap problem.

Wuerz, in U.S. Pat. No. 142,832 (1873), discloses a device with a curved, slotted pivot point rather than a fixed pivot point. This curved, slotted pivot allowed the deflection surface to translate as well as rotate to help reduce plate gap.

West, in U.S. Pat. No. 246,930 (1881), discloses an "inclined ledge" within the main body, such that the rear wall of the main body projects inwardly to close the plate gap.

Fisher, in U.S. Pat. No. 289,821 (1883), discloses a fixed-pivot-point device provided with an inner chamber to " . . . [deflect] a column or stream of water . . . upon the [diverter surface]."

Weightman, in U.S. Pat. No. 458,768 (1891), discloses a sliding-pivot-point device with interior "guards" to direct water away from the rear wall of the main body.

Then, in 1898, Epple, in U.S. Pat. No. 608,765, would be the first to disclose an "in-swing geometry" cistern cutoff device that eliminated the plate gap problem. Epple's device placed the deflection surface above the hinge and allowed it to rotate inward at an angle less than 90°, where it came to rest against the back wall of the main body.

Epple exploited the advantages of the in-swing geometry by disclosing a cistern cutoff that was free of movable pivot points, inner chambers, and rear-wall flanges or deflectors. Besides this change in geometry, another distinguishing feature of Epple's design was an "out-of-plane" front wall on a portion of the main body. A discussion of out-of-plane walls will be addressed at the end of this section, relating to the topic of leak-resistance.

Harms, in U.S. Pat. No. 3,990,474 (1976), discloses a second example of an in-swing geometry water diversion device. Rather than fixing a pivot point between the main body and the diverter plate, however, Harms allows the diverter plate to tilt and translate about the lower edge of the main body aperture.

Johnson, in U.S. Pat. No. 6,024,127 (2000), discloses a downspout clean out adapter similar in operation to Harms' diverter. Unlike Harms' free floating plate, however, Johnson discloses "guides" that hold the diverter plate in either a vertical or an inclined position.

A disadvantage to Johnson's use of "guides" to position the plate is that it requires the operator to perform six motions—raising, removing, rotating longitudinally (tilting), rotating laterally (flipping), reinserting, and locking downward—to operate the device.

A second disadvantage of Johnson's design is that it specifies a spout (the lower half of the deflection plate that extends outward and downward from the aperture). It can be noted that all other prior art, as well, disclosed the use of a spout on the distal end of the diverter plate. In the earlier cistern cutoff devices, the spout performed two functions; it provided a means to channel the water into a rain barrel for collection, and it functioned as a handle by whose means the plate was repositioned. As Johnson made the shift from a rain collection device to a debris cleanout device for downspouts, however, the channeling function of the spout would no longer be required: Where a cistern cutoff device was designed to collect water, a downspout cleanout device could be allowed to discard it. Johnson, however, could not eliminate the spout because his design required its secondary use as a handle.

By relying on spouted diverter plates, the prior art disclosed designs that are inefficient (in terms of material usage, overall dimensions, and appearance) compared to a device that could be made to function without a spout. For example, the vertical profile of non-spouted device could be reduced by as much as 50% from that of a spouted device by eliminating the lower half of the deflection surface (the spout) and the corresponding length of the main body.

A final aspect of the prior art that warrants discussion is that of leak-resistance features. The remainder of this section will focus on this topic.

In the early cistern cutoff devices, no discussion was made regarding features that inhibited water leakage from the closed aperture.

Wuerz (U.S. Pat. No. 142,832) became the first to suggest the desirability of leak resistance by disclosing that the fit of the spout against the main body, when closed, was to be, " . . . of such correspondence as to ensure a tight joint."

West (U.S. Pat. No. 246,930) also touched on the desirability of a leak resistant design by specifying that, when closed, " . . . the bottom of the spout to [is to] bear closely upon the frame [main body]."

Similarly, Harms (U.S. Pat. No. 3,990,474) describes his device, in the closed position, to be such that, " . . . the diverter plate lays close along the side wall of the downspout."

Epple (U.S. Pat. No. 608,765) makes a specific claim regarding an "out-of-plane wall" in his cistern cut-off device. Epple describes moving the upper wall (the wall containing the aperture) outward from the plane of flow and bringing the lower wall (the wall below the aperture) inwardly back into the flow plane. Epple's purpose for this was to specify the proper positioning of the deflection surface's pivot point, which, in this case, was the top edge of the lower wall itself.

Intuitively, it can be seen that Epple might have gained a measure of leak resistance by moving the aperture forward, out of the plane of flow. However, by moving the lower wall back into the plane, Epple effectively reduced any leak-resistance benefits he might have achieved from the upper out-of-plane wall: Rather than transferring fluid from a smaller area above to a larger area below, as one does when pouring fluid from a small container into the larger, open end of a funnel, Epple does the reverse. With the lower flow area smaller than the upper area, the opportunity for fluid leaks from the lower area is increased.

Epple's prior art fails to teach the use of out-of-plane walls as a means of enhancing leak resistance. Thus, the collection of prior art is left with only Wuerz's, West's, and Harm's "tight-fit" approach to addressing the problem of leakage from cistern cutoff type fluid diversion devices.

SUMMARY

The invention is a downspout flow diverter for diverting water from a gutter downspout to an alternate location outside the downspout.

In accordance with one embodiment of the invention, a downspout flow diverter comprises a main body with an aperture, a diverter plate, a seepage barrier, a drain void, a sliding jacket, and an installation collar.

The sliding jacket assists in the positioning of the diverter plate and interacts with the main body, the diverter plate, the seepage barrier, and the drain void to help limit leakage from the device.

The installation collar helps simplify the installation of the device on pre-installed downspouts.

The foregoing and other objects, features, and advantages of this invention will become more readily apparent from the following detailed descriptions of a first embodiment and various alternate embodiments which proceed with reference to the accompanying drawings, wherein the embodiments of the invention are shown and described, simply by way of illustration of preferred modes of carrying out the invention. As will be realized, the invention is capable of other and different embodiments, and its several details are capable of modifications in various obvious respects, all without departing from the invention.

DRAWINGS

Figures

DRAWINGS—REFERENCE NUMERALS

First Embodiment of the Invention

Figures 1, 1A:
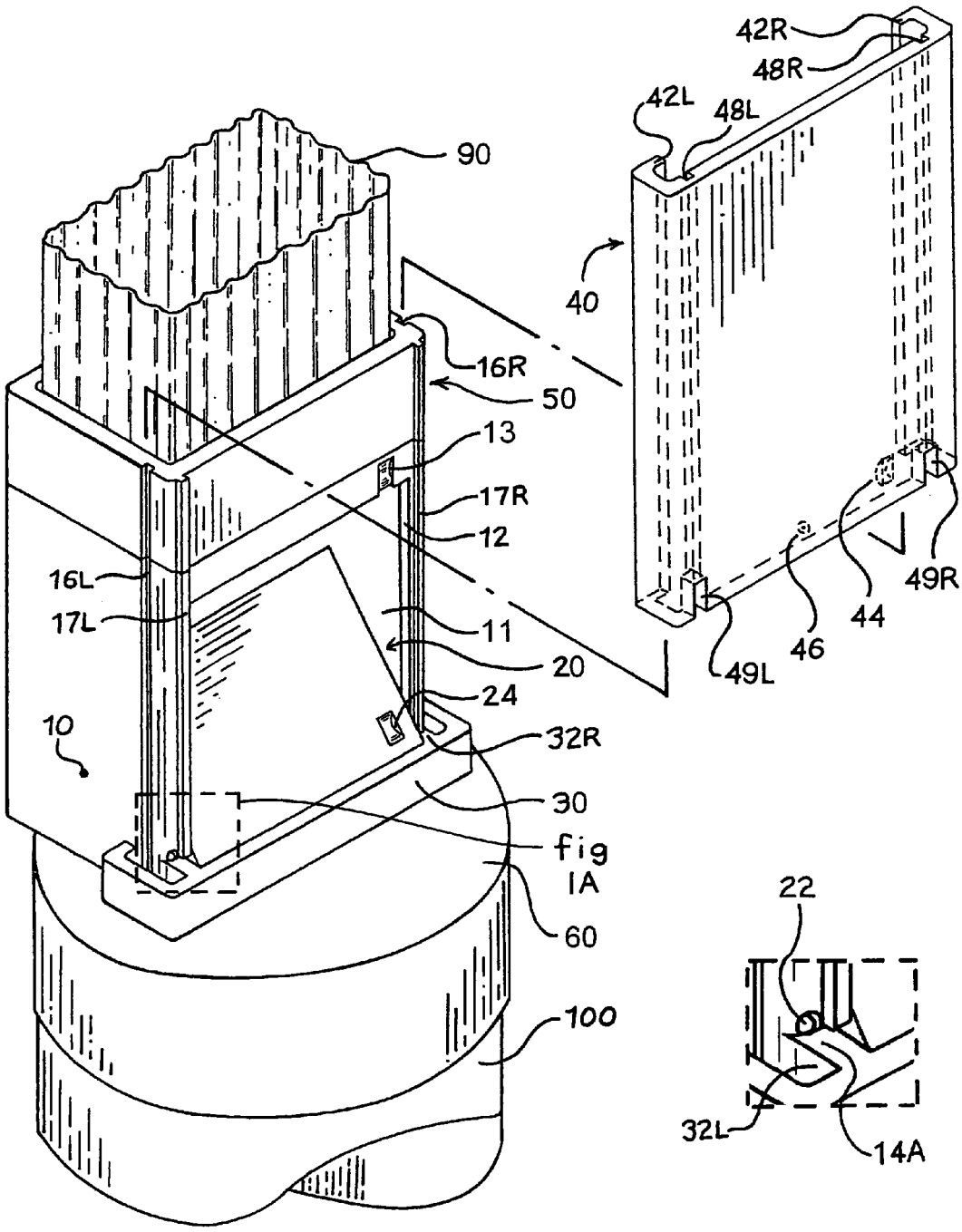
FIG. 1 is a perspective view of the first embodiment of the invention with an exploded view of the embodiment's sliding jacket.
FIG. 1A is a magnified view of the first embodiment's pivot axle region.

Major components of the first embodiment are numbered in multiples of ten. Detailed components of the first embodiment are numbered according to the major component to which they are related (i.e., components 22, 24 are detailed subcomponents of major component 20).

| | |
|---|---|
| 10 | main body |
| 11 | interior passage |
| 12 | aperture |
| 13 | bi-curved groove |
| 14A | pivot slot |
| 14B | pivot hole |
| 16L, 16R | jacket furrows |
| 17L, 17R | aperture fences |
| 19 | female coupling |
| 20 | diverter plate |
| 22 | pivot axle |
| 24 | concave groove |
| 30 | seepage barrier |
| 31 | drain void |
| 32L, 32R | barrier dividers |
| 40 | sliding jacket |
| 42L, 42R | jacket rails |
| 44 | opening lobe |
| 46 | closing lobe |
| 48L, 48R | fence furrows |
| 49L, 49R | barrier slots |
| 50 | installation collar |
| 52 | male coupling |
| 60 | pipe cap-fitting |
| 90 | downspout |
| 100 | drain pipe |

Additional Reference Numerals for Alternate Embodiment #1

117L, 117R aperture fences

Additional Reference Numerals for Alternate Embodiment #2

| | |
|---|---|
| 200 | hinge |
| 202 | actuation lever |
| 204 | detent lock |
| 220 | seating receptacle |

DETAILED DESCRIPTION

First Embodiment FIGS. 1-4

FIG. 1 provides a partially exploded perspective view of the first embodiment of the invention. The embodiment consists of a rectangular main body 10, a diverter panel, surface, or plate 20, a seepage catch, wall, or barrier 30, a sliding cover, fairing, or jacket 40, an installation fitting, sleeve, or collar 50, and a pipe cap-fitting 60. The main body 10, the seepage barrier 30, and the pipe cap-fitting 60 are preferably molded as a single piece using PVC, ABS, styrene, vinyl, or other durable plastic. The molding method of construction and similar materials are also recommended for all other components and surface features of such components present in this embodiment.

Main Body (10): FIG. 1 illustrates that the main body 10 defines an interior chamber or passage 11, and comprises an opening, cut-out, or aperture 12. The interior passage 11 defines a path through which water flows to a primary location. The aperture 12 defines an outlet from which the water can be redirected from the interior passage 11 to an alternate location outside the main body 10.

FIG. 1 additionally shows that the main body 10 comprises a bi-curved recess, fossa, or groove 13, located on the front surface of the main body 10, just above the aperture 12.

Additionally, FIGS. 1 and 1A show other features of the main body 10, including a pivot notch, cutout, or slot 14A (FIG. 1A), located on the lower front surface of the main body 10; two jacket tracks, grooves, or furrows 16L and 16R which run vertically, one on each side surface of the main body 10; and two aperture lips, edges, or fences 17L and 17R which run vertically along the front surface of the main body 10, one on each side of the aperture 12.

Figure 3A:
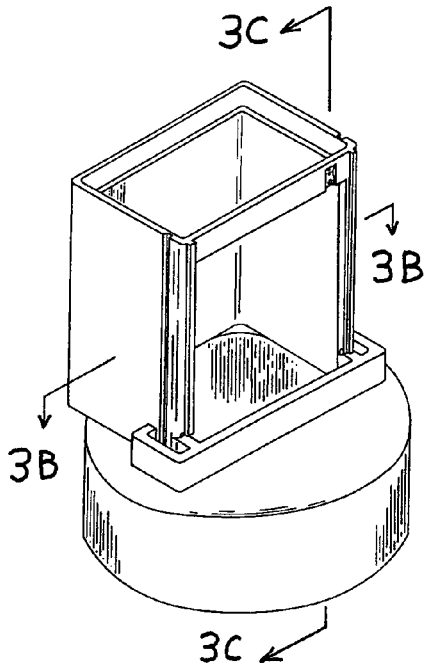
FIG. 3A is a representative view of the first embodiment's main body depicting the location of sectional view 3B.
Figure 3C:
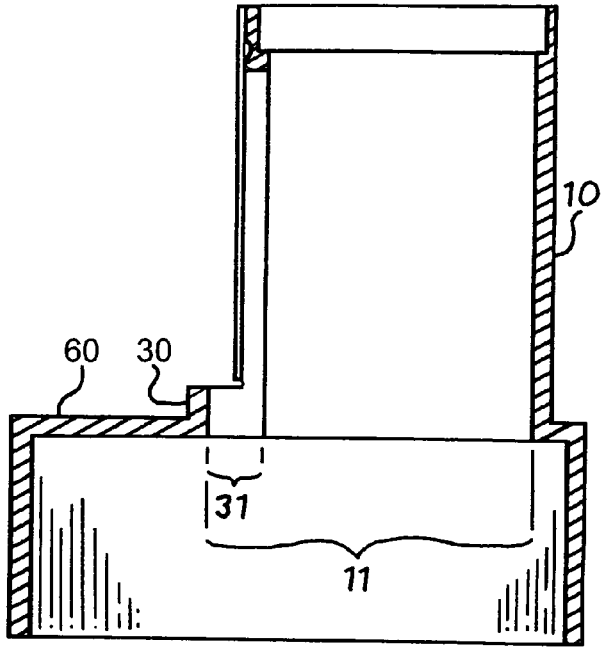
FIG. 3C is a side sectional view of the first embodiment's main body, interior passage, seepage barrier, drain void, and pipe cap-fitting.
Figure 3B:
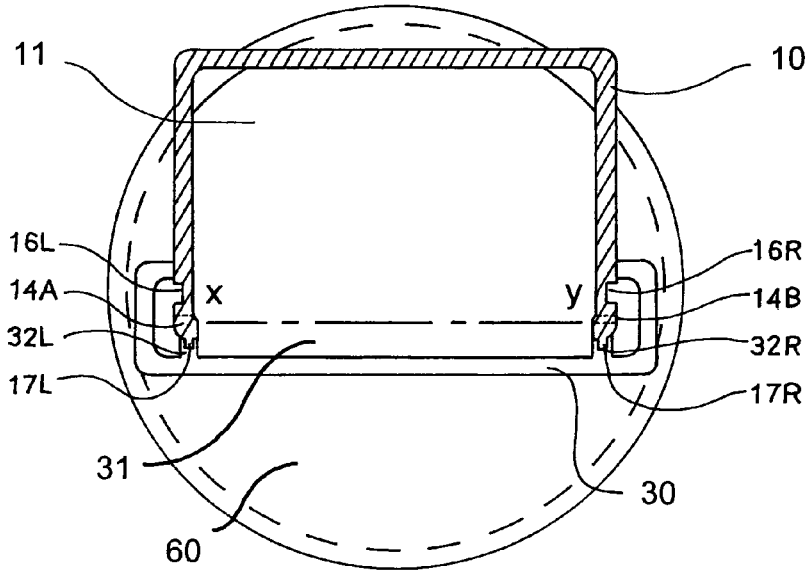
FIG. 3B is a top sectional view of the first embodiment's main body, interior passage, seepage barrier, drain void, and pipe cap-fitting.

Diverter Plate (20): FIGS. 1, 1A, and 3B illustrate that the diverter plate 20 is pivotally supported from the main body 10 by a pivot axle 22 (FIG. 1A) passing through the pivot slot 14A and a pivot hole 14B (FIG. 3B). The diverter plate 20 (FIG. 1) is thus disposed to pivot from a stowed position, aligned with the aperture 12, to a diverting position, where a portion of the diverter plate 20 extends into the interior passage 11. The diverter plate 20 also comprises a concave recess, fossa, or groove 24, on its lower forward surface.

Figure 2:
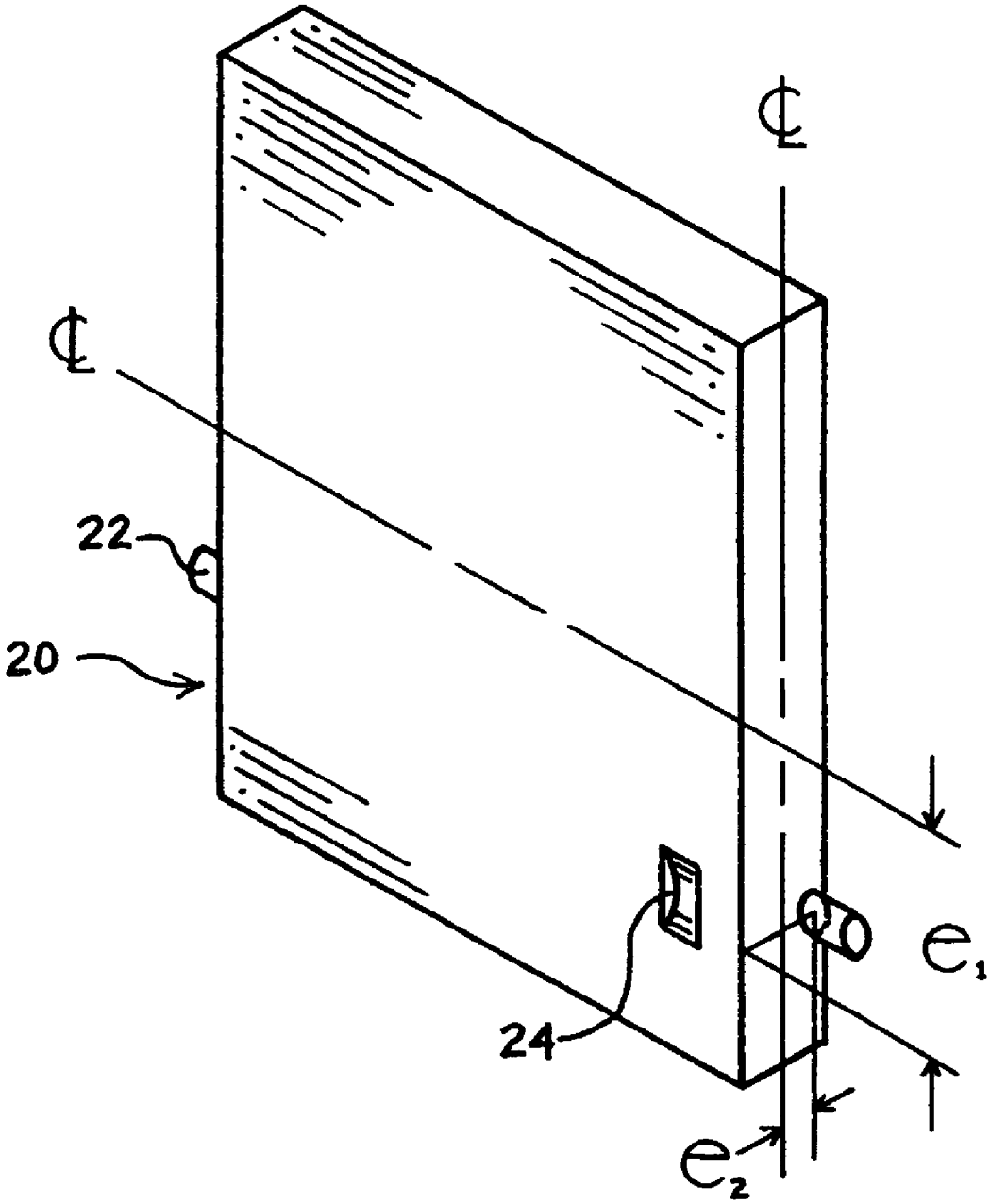
FIG. 2 is a perspective view of the first embodiment's diverter plate, pivot axle, and concave groove.

FIG. 2 provides a detailed view of the diverter plate 20, the pivot axle 22, and the concave groove 24. The pivot axle 22 is preferably molded as a single piece with the diverter plate 20. The location of the pivot axle 22 is such that it lies closer to the lower edges of the diverter plate 20 than to upper edges of the diverter plate. Additionally, the location of the pivot axle 22 is such that it lies closer to the aft surface of the diverter plate 20 than to the forward surface of the diverter plate. FIG. 2 further illustrates that the concave groove 24, located on the lower forward surface of the diverter plate 20, is vertically centered slightly above the pivot axle 22.

Seepage Barrier (30): FIG. 1 shows that the seepage barrier 30 is affixed to the side surfaces of the main body 10 and to the upper surface of the pipe cap-fitting 60 such that the seepage barrier 30 is outwardly offset from the frontal plane of the aperture 12.

FIGS. 1 and 1A further illustrate that the seepage barrier 30 comprises a pair of barrier partitions, guards, or dividers 32L and 32R. The barrier dividers 32L and 32R extend perpendicularly between the inner wall of the seepage barrier 30 and the front surface of the main body 10, in direct alignment with the aperture fences 17L and 17R. The barrier dividers 32L and 32R thus separate the seepage barrier 30 into three sections; a center section aligned with the aperture 12, and two outer sections that wrap around the side surfaces of the main body 10.

FIG. 3B shows additional attributes of the seepage barrier 30 and the main body 10 in a top sectional view. Inward of the center section of the seepage barrier's 30 inner wall, the top surface of the pipe cap-fitting 60 has been cut away to create a drain passage, channel, or void 31. The drain void 31 is depicted as the area between the line x-y and the inner wall of the seepage barrier 30.

FIG. 3B also depicts the interior passage 11, of the main body 10. The interior passage 11 initially comprises the area shown bounded by the line x-y and the aft interior surface of the main body 10. Below the seepage barrier 30, however, as shown in FIG. 3C, the interior passage 11 further comprises the area within the drain void 31. Thus, the seepage barrier 30 defines the drain void 31, which creates an enlarged passage that combines with the existing interior passage 11, to create an enlarged interior passage 11.

Sliding Jacket (40): FIG. 1 illustrates that the sliding jacket 40 is disposed for sliding engagement with the main body 10. Jacket guides, tracks, or rails 42L and 42R on either side of the sliding jacket 40 fit into the jacket furrows 16L and 16R of the main body 10 to guide the vertical translation of the sliding jacket 40 from a first position covering the aperture 12 to a second adjacent position exposing the aperture 12.

FIG. 1 also shows that the sliding jacket 40 possesses an opening nodule, boss, or lobe 44, and a closing lobe 46 on its lower aft surface.

Additionally, FIG. 1 shows other features of the sliding jacket 40, including a pair of fence furrows 48L and 48R, on the aft surface of the sliding jacket 40, and a pair of barrier notches, cut-outs, or slots 49L and 49R that pass perpendicularly through the lower surfaces of the sliding jacket. The fence furrows 48L and 48R are positioned so as to receive the aperture fences 17L and 17R, of the main body 10, when the sliding jacket 40 is installed on the main body 10. The fence furrows 48L and 48R and the aperture fences 17L and 17R thus partition the aft surface of the sliding jacket 40 into three sections; a center section aligned with the aperture 12, and two outer sections that wrap around the side surfaces of the main body 10. Accordingly, when the sliding jacket 40 is installed on the main body 10, the center section of the sliding jacket lays in direct alignment the center section of the seepage barrier 30. The barrier slots 49L and 49R are positioned so as to seat around the barrier dividers 32L and 32R, of the seepage barrier 30, when the sliding jacket 40 is fully lowered on the main body 10.

Figure 4:
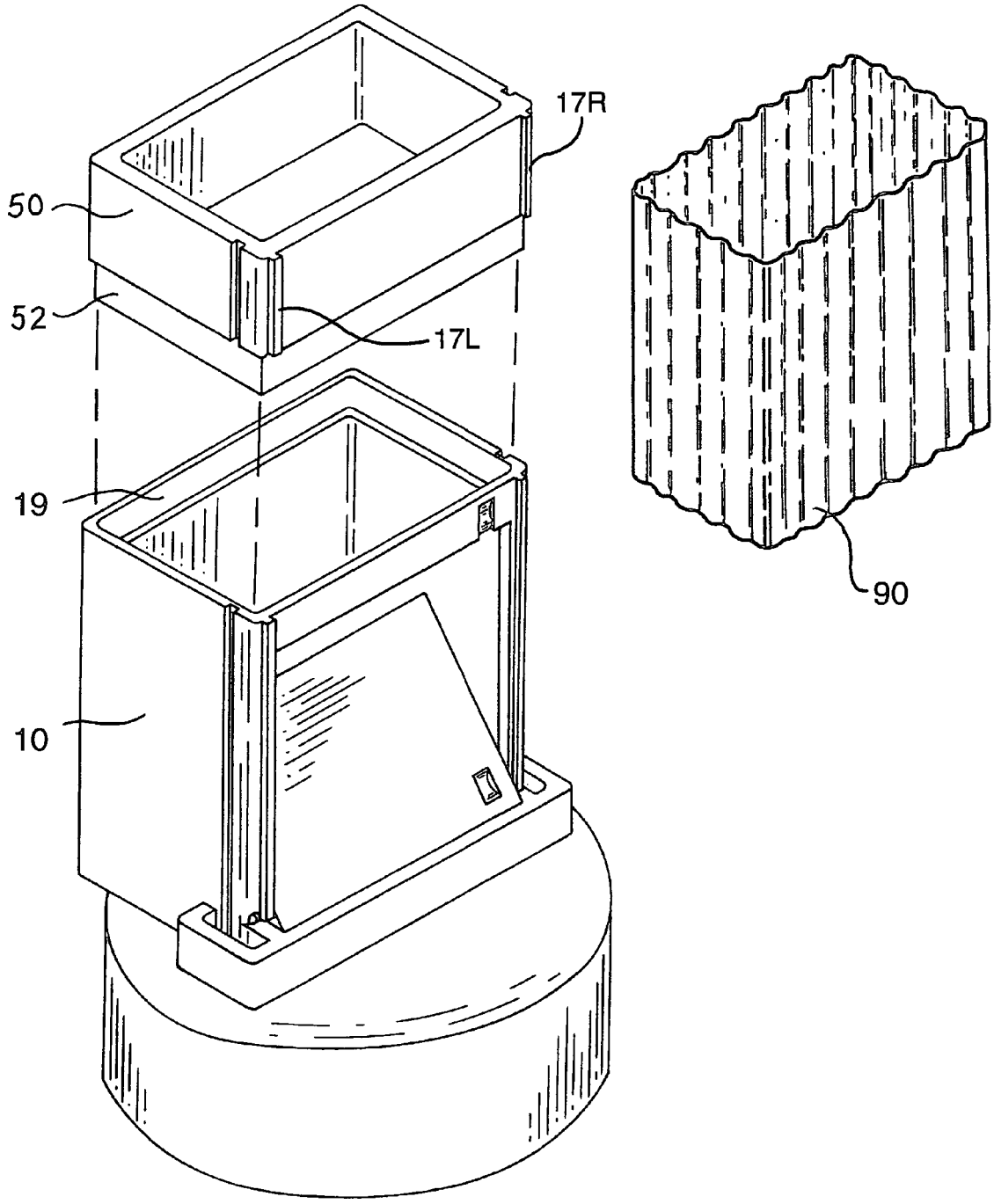
FIG. 4 is a perspective view of the first embodiment with an exploded view of the removable installation collar.

Installation Collar (50): FIG. 1 shows the installation collar 50 seated atop the main body 10, while FIG. 4 shows the installation collar 50 separated from the main body 10. The interior of the installation collar 50 is formed to slide over the outer surface of a downspout 90. FIG. 4 further shows that the lower portion of the installation collar 50 consists of a male coupling 52 formed by reducing a portion of the installation collar's outer wall thickness by approximately 50%. The male coupling 52 seats inside a female coupling 19 atop the main body 10. The female coupling 19 is formed by reducing a portion of the main body's 10 inner wall thickness by approximately 50%. The installation collar 50 is thus vertically separable and re-insertable from the main body 10.

Similar to the main body 10, the installation collar 50 possesses a pair of jacket furrows 16L and 16R (FIG. 1) and a pair of aperture fences 17L and 17R that align with the same features of the main body 10 when the installation collar is fitted onto the main body.

OPERATION

First Embodiment

Installation—FIGS. 1, 4: Prior to use, an operator must install the embodiment on the proximal, above ground end of a vertically buried drain pipe 100 (FIG. 1) so that the aperture 12 faces outward, away from the structure. This is done by sliding the pipe cap-fitting 60 over the exposed end of the drain pipe 100. The pipe cap-fitting 60 may be slip-fit onto the drain pipe 100 or it may be secured with pipe dope or other adhesive.

For new downspout 90 installations, the operator simply inserts the lower end of the downspout into the top of the installation collar 50, before mounting the downspout to the structure. The bottom of the downspout 90 should be set to a height just above the top of the main body 10.

If an existing downspout 90 is inserted into the drain pipe 100, the downspout must be removed from the drain pipe before installing the embodiment. After the downspout 90 has been removed from the drain pipe 100, the operator may use the installation collar 50 to simplify the remaining installation.

To use the installation collar 50 (FIG. 4), the operator lifts the installation collar upward, unseating the male coupling 52 from the female coupling 19. The operator then positions the lower, distal end of the pre-existing downspout 90 to either side of the main body 10. With the installation collar 50 removed, the distal end of the downspout 90 is marked and cut so that the downspout 90 just clears the upper edges of the female coupling 19. The installation collar 50 is then slid onto the downspout 90 so that the aperture fences 17L and 17R face outward, away from the structure. The downspout 90 and installation collar 50 are then centered over the main body 10, and the installation collar 50 is slid downward until the installation collar's male coupling 52 seats fully inside the female coupling 19 of the main body 10. This connects the downspout 90, in the proper position, to the main body 10.

Figure 5A:
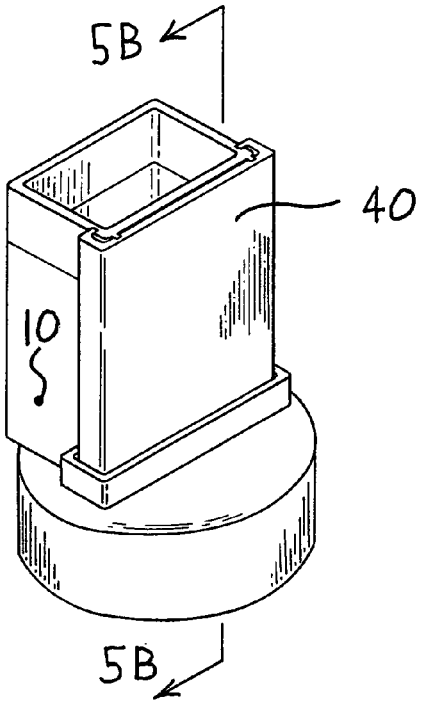
FIG. 5A is a representative view of the first embodiment in the stowed position, depicting the location of sectional view 5B.
Figure 5B:
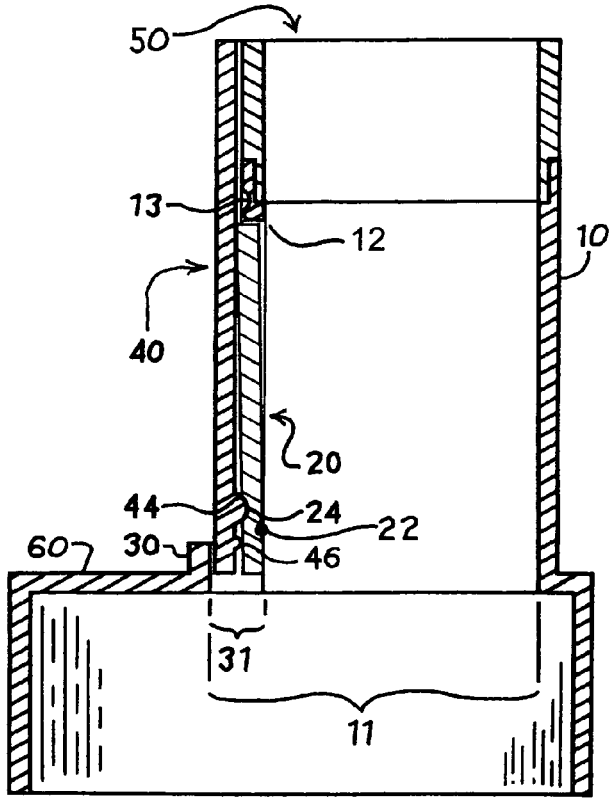
FIG. 5B is a side sectional view illustrating the geometry of the first embodiment's elements in the stowed position.

Operation in the Stowed Position—FIG. 5B: After the embodiment has been installed, and with the sliding jacket 40 in the lowered position covering the aperture 12, the embodiment is in its stowed, or closed, position. FIG. 5B provides a side sectional view of this position.

Note that the closing lobe 46, of the sliding jacket 40, makes forcible contact with the diverter plate 20. As this point of contact is below the pivot axle 22, the closing lobe 46 forces the lower portion of the diverter plate 20 inward to a slightly over-center position. This helps ensure that the top surface of the diverter plate 20 lies slightly outwardly offset from the top surface of the aperture 12, so as to not create an impediment to the downward flow of fluid inside the interior passage 11. Also note that the opening lobe 44, of the sliding jacket 40, seats within the concave groove 24, of the diverter plate 20.

In this stowed position, the sliding jacket 40, the seepage barrier 30, and the drain void 31 work together to help recapture leakage from the aperture 12. Fluid that leaks from aperture 12 is trapped between the aft surface of the sliding jacket 40, the aperture fences 17L and 17R (FIG. 1), and the stowed diverter plate 20. Gravity causes the trapped leakage to flow downward, along the center section of the sliding jacket's 40 aft surface until the sliding jacket terminates within the seepage barrier 30 (FIG. 5B). When the trapped leakage reaches the seepage barrier 30, it re-enters the interior passage 11 by passing though the drain void 31. Thus, the drain void 31, by creating an enlarged interior passage 11, additive to the upper interior passage 11, provides a means to recapture the trapped leakage.

Figure 6A:
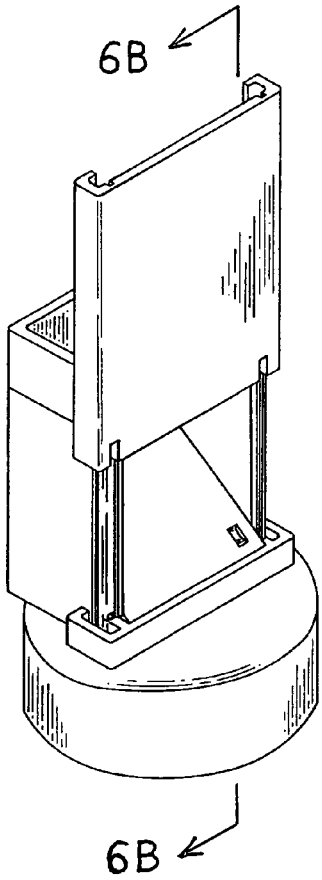
FIG. 6A is a representative view of the first embodiment in the diverting position, depicting the location of sectional view 6B.
Figure 6B:
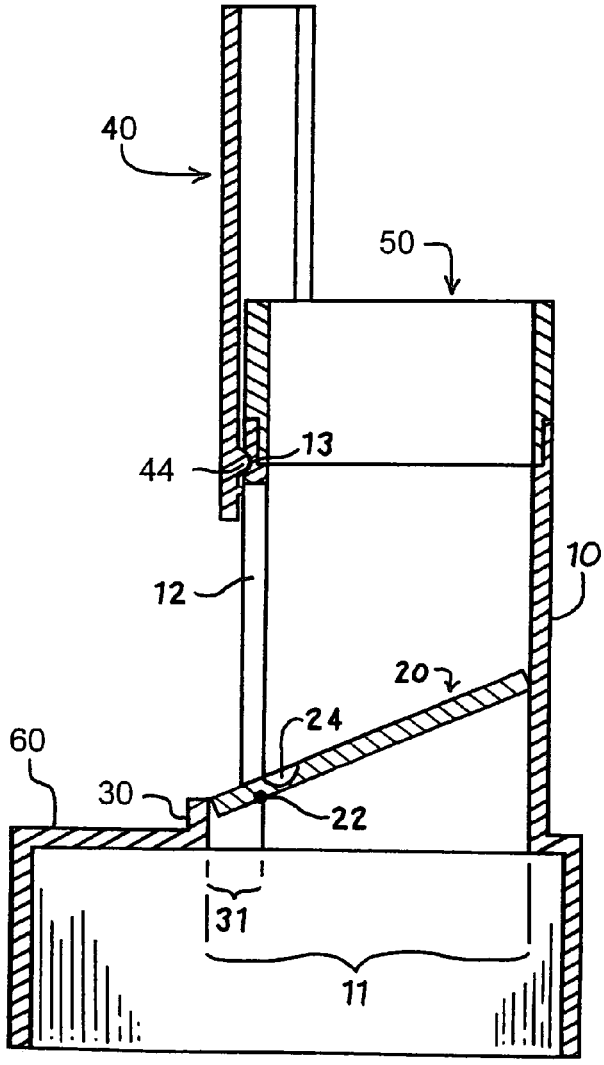
FIG. 6B is a side sectional view illustrating the geometry of the first embodiment's elements in the diverting position.

Operation in the Diverting Position—FIGS. 2, 5B, 6B: To open the embodiment, for example when an operator desires to flush debris from a gutter, the operator raises the sliding jacket 40 (FIG. 5B) in a smooth, upward motion until the sliding jacket seats into position above the aperture 12. When the sliding jacket 40 is initially raised, the opening lobe 44 contacts the upper surface of the concave groove 24, urging the diverter plate 20 to rotate inwardly. Simultaneously, however, the closing lobe 46 resists this rotational urging. Flexible play in the sliding jacket 40 and diverter plate 20 allows these counteracting forces to create a compressive force between the two parts. Just prior to the point where the opening lobe 44 reaches the upper extent of the concave groove 24, the closing lobe 46 passes abeam the pivot axle 22, releasing the compressive force, causing the diverter plate 20 to snap to its fully open, diverting position (FIG. 6B).

As the diverter plate 20 rotates inwardly, it is affected by two rotational eccentricities resulting from the off-center placement of the pivot axle 22. The eccentricity $e_1$ (FIG. 2), relative to the vertical centerline of diverter plate 20, causes the lower edges of the diverter plate to rotate outwardly as the upper edges of the diverter plate rotate inwardly. The eccentricity $e_2$, relative to the depth-wise centerline of the diverter plate 20, causes the lower edges of the diverter plate to lift slightly as they rotates outwardly.

The outward rotation of the lower edges of the diverter plate 20, causes the lower forward surface of the diverter plate to shield the drain void 31 (FIG. 6B), hindering the entry of fluid and debris into the drain void 31, while the diverter plate 20 is in its inward, diverting position.

The lifting of the lower edges of the diverter plate 20 ensures that the diverter plate's lower forward edge forms a close fit with the upper inner edge of the seepage barrier 30. Such close fit ensures that no lip or gap is created at the joint formed by the diverter plate 20 and the seepage barrier 30. The absence of such lip or gap facilitates the flow of fluid and debris over the seepage barrier 30.

As the sliding jacket 40 is raised further, the opening lobe 44 is brought into contact with the bi-curved groove 13, aligned therewith, on the upper forward surface of the main body 10. Flexible play in the sliding jacket 40 allows the opening lobe 44 to pass over the apex of the lower, convex contour of the bi-curved groove 13 with slight resistance. After passing the apex of the lower contour, the opening lobe 44 is held in place by the upper, concave contour of the bi-curved groove 13, thereby maintaining the sliding jacket 40 in the raised position, exposing the aperture 12.

Removal of the Diverter Plate—FIGS. 1, 1A, 3B: To remove the diverter plate 20, for example when an operator desires access to the drain pipe 100 for a hose or drain snake, the operator first raises the sliding jacket 40. Raising the sliding jacket 40 causes the diverter plate 20 to fall to its inward, diverting position. Using a flat object such as a coin or knife blade, the operator pushes against the lower forward surface of the diverter plate 20 below the pivot axle 22 (FIGS. 1, 1A), until the diverter plate is rotated outwardly from the aperture 12. The user then grasps the edges of the diverter plate 20 to manipulate the pivot axle 22 laterally forward from the pivot slot 14A. Once laterally free of the pivot slot 14A, the pivot axle 22 can then be axially removed from the pivot hole 14B (FIG. 3B), freeing the diverter plate 20 from the main body 10.

The operator may re-attach the diverter plate 20 by repeating these steps in reverse.

Returning to the Stowed Position—FIGS. 5A, 5B, 6B, 7: To return the embodiment to the stowed, or closed, position, the operator pushes down on the top of the sliding jacket 40 (FIG. 6B) to unseat the opening lobe 44 from the bi-curved groove 13. With the opening lobe 44 unseated, the sliding jacket 40 is free to translate lower until its lower aft edge contacts the lower forward surface of the inclined diverter plate 20. Since this line of contact is between the pivot axle 22 and the lower edges of the diverter plate 20, further downward movement of the sliding jacket 40 causes the lower edges of the diverter plate 20 to rotate inwardly, and, thus, the upper edges of the diverter plate to rotate outwardly, toward their vertical, stowed position. With the sliding jacket 40 fully lowered (FIG. 5B), the diverter plate 20 is held in its fully stowed, slightly over-center position by the closing lobe 46.

Figure 7:
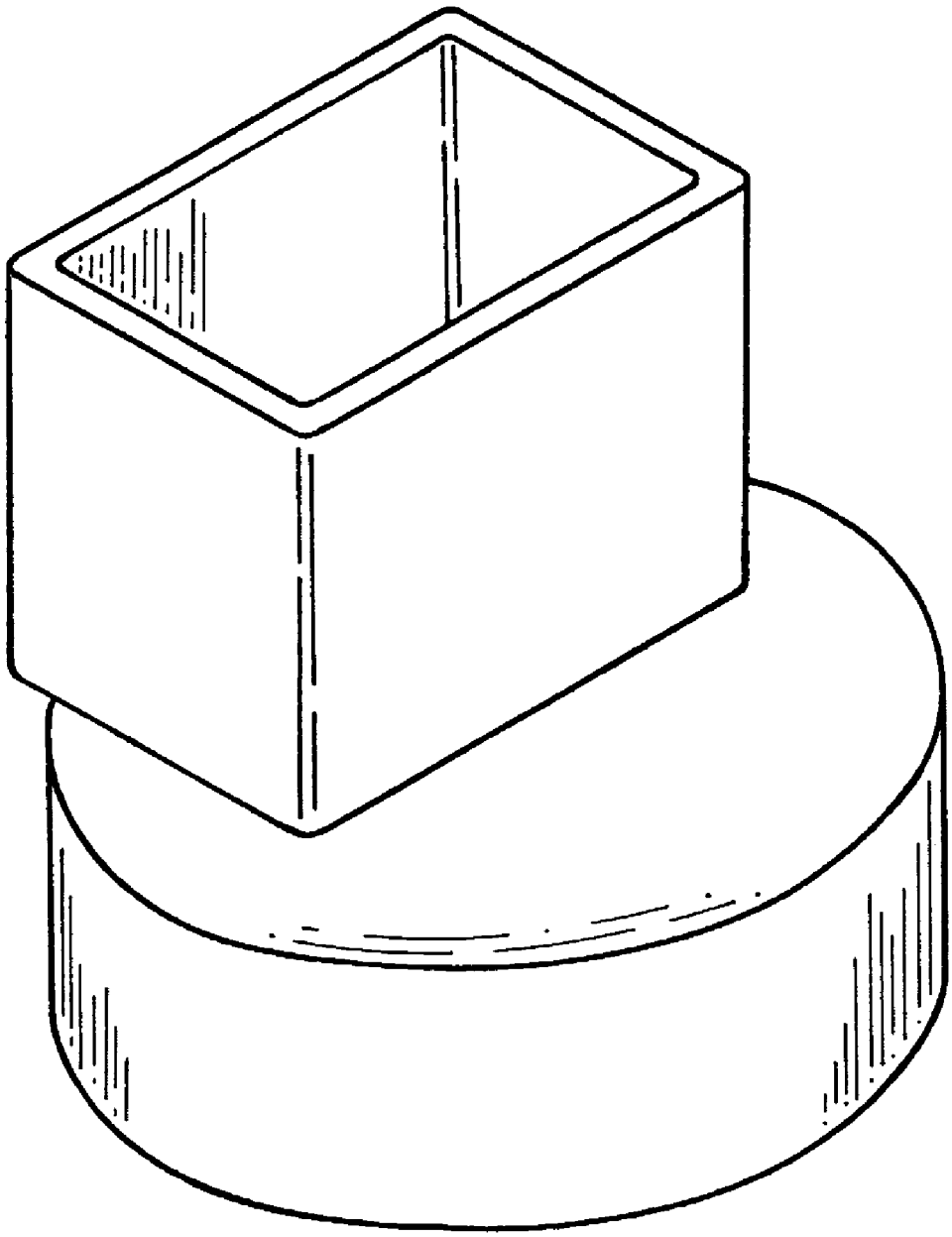
FIG. 7 (Prior Art)
FIG. 7 (prior art) depicts a typical, non-functioning downspout-to-drain-pipe adapter.

In the fully lowered position, the sliding jacket 40 additionally provides an aesthetic frontal veneer for the main body 10 (FIG. 5A). In this position, the sliding jacket 40 hides the interior features of the embodiment. By hiding these features, the sliding jacket 40 allows the embodiment to mimic the appearance of a typical non-functioning downspout adapter (FIG. 7-P*rior* Art).

DETAILED DESCRIPTION—ALTERNATE EMBODIMENTS

Alternate Embodiment #1

FIGS. 8, 9, 10

The previous embodiment of the invention disclosed pairs of jacket furrows 16L/16R, aperture fences 17L/17R, and fence furrows 48L/48R.

Figure 8:
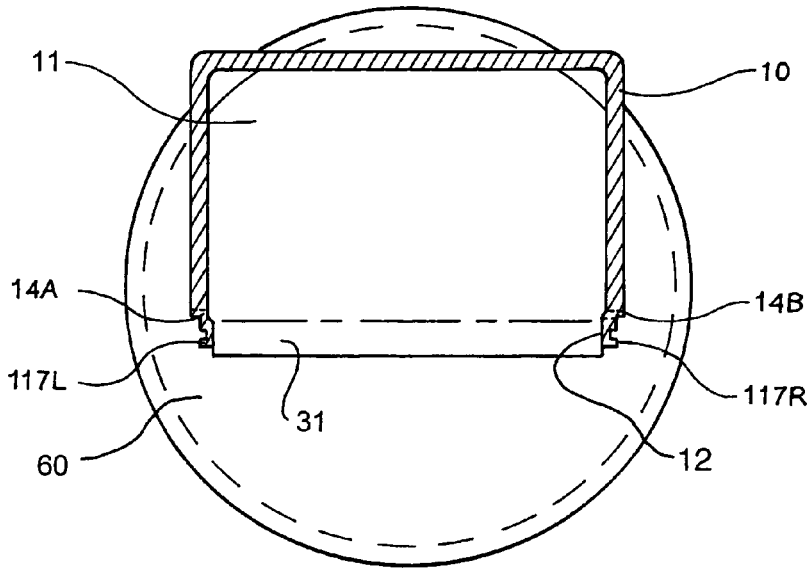
FIG. 8 is a top sectional view of alternate embodiment #1.
Figure 9:
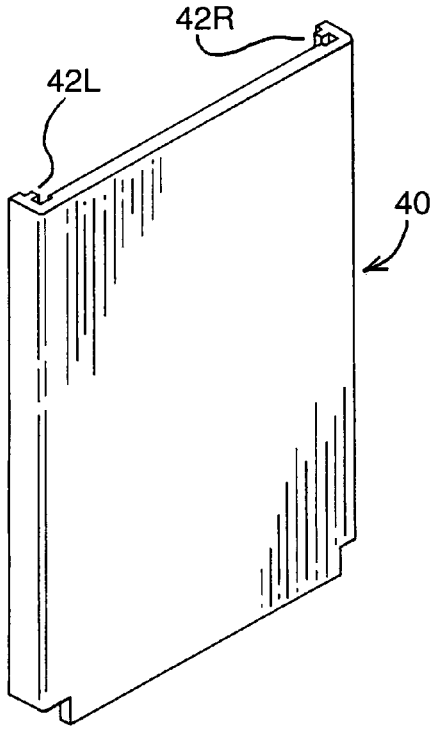
FIG. 9 is a perspective view of the sliding jacket of alternate embodiment #1.

Alternate embodiment #1 combines the functions of the jacket furrows 16L/16R and the aperture fences 17L/17R into a single pair of L-shaped aperture fences 117L and 117R (FIG. 8). The "L" shape allows the aperture fences 117L and 117R to accommodate the travel of the jacket rails 42L/42R (FIG. 9), of the sliding jacket 40, while also inhibiting the lateral flow of leakage. Alternate embodiment #1 further eliminates the fence furrows 48L/48R, of the previous embodiment.

Alternate embodiment #1 also eliminates the outer left and outer right sections of the seepage barrier 30, presented in the previous embodiment. This allows the seepage barrier 30 to be reduced to its center section only, which is aligned with the aperture 12. Additionally, after eliminating the outer sections of the seepage barrier 30, one can visualize the effect of "lowering" the seepage barrier's remaining center section into the upper surface of the pipe cap-fitting 60 such that the top of the seepage barrier 30 is flush with the top of the pipe cap-fitting 60. Such "lowering" of the seepage barrier 30 is accompanied by an equivalent "lowering" of the main body 10 to maintain the relative positions of the aperture 12 and pivots points 14A, 14B with respect to the seepage barrier 30.

Figure 10:
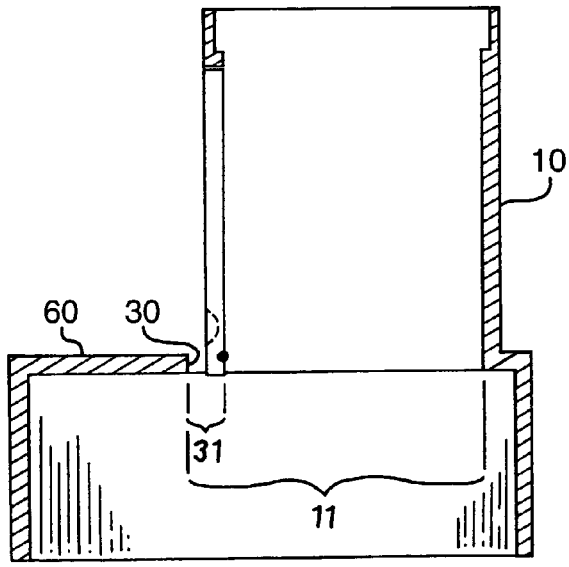
FIG. 10 is a side sectional view of alternate embodiment #1.
Figure 11:
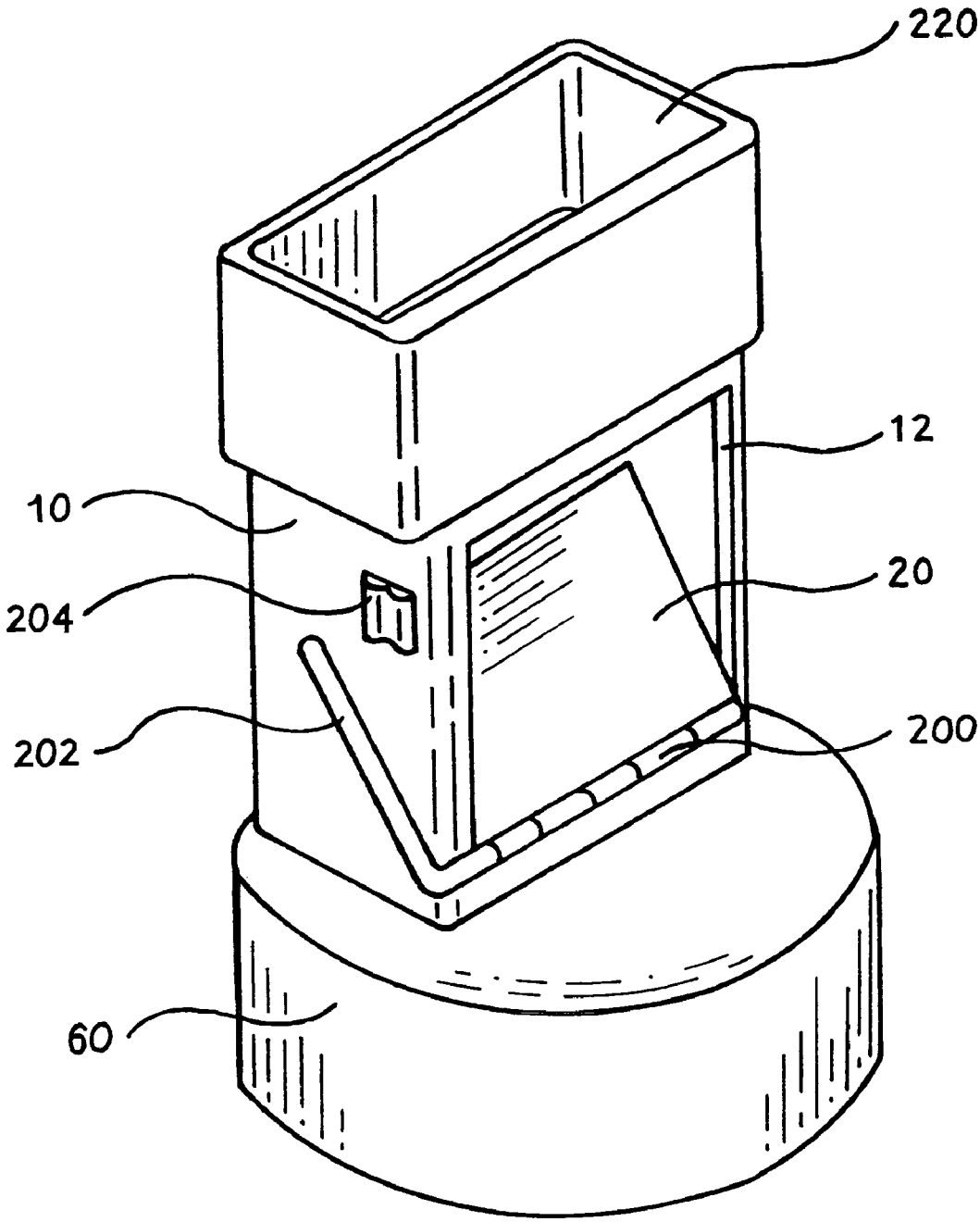
FIG. 11 is a perspective view of alternate embodiment #2.

It can be noted that "lowering" the seepage barrier 30, as described above, renders the top of the seepage barrier indistinguishable from the upper surface of the pipe cap-fitting 60 (FIG. 10). Thus, that portion of the seepage barrier 30 which would extend below the thickness of the pipe cap-fitting 60 can be eliminated with no ill effect, since any leakage that reaches the top of the "lowered" seepage barrier 30 has simultaneously reached the drain void 31 and re-entered the interior passage 11.

The lower corners of the sliding jacket 40 (FIG. 9) can then be removed to allow the sliding jacket's center section to penetrate the drain void 31, when the sliding jacket 40 is lowered to the stowed position on the main body 10.

Alternate Embodiment #2

FIG. 11

Compared to the first embodiment, alternate embodiment #2 eliminates the pivot axle 22, the seepage barrier 30, the sliding jacket 40, the installation collar 50, and features of the main body 10 and diverter plate 20 that communicate with the sliding jacket 40.

The pivot axle 22 is replaced by a full-length hinge 200 connecting the diverter plate 20 to the main body 10. That portion of the hinge 200 affixed to the diverter plate 20 is also affixed to a hinge pin with a protruding end of sufficient length to be bent to form an actuation lever 202. The hinge 200 and actuation lever 202 are preferably made of an oxidation-resistant metal.

Rotation of the actuation lever 202 results in a corresponding rotation of the diverter plate 20. To lock the actuation lever 202 and diverter plate 20 in the vertical, stowed positions, a detent lock 204 is provided on the side surface of the main body 10. The actuation lever 202 also provides the capability of rotating the diverter plate 20 outwardly from the aperture 12 to allow access to pipes below the pipe cap-fitting 60.

Alternate embodiment #2 further incorporates a seating receptacle 220 atop the main body 10 that can be fashioned to receive downspouts of varied shapes and sizes.

CONCLUSION, RAMIFICATIONS, AND SCOPE

At least one embodiment of the downspout flow diverter provides a simple, efficient, and attractive device for diverting water in downspouts away from underground drain lines.

This and other embodiments provide advantages over the prior art, including a reduction in vertical profile, simplified operation and installation, improved leak resistance, enhanced durability, and a more streamlined visual appearance.

Such advantages may be of great significance to home and business owners who desire ease of use and efficient operation in a downspout flow diverter, while also desiring to minimize the visual impact of such a device upon their homes and offices.

Having illustrated and described the principles of my invention in several embodiments thereof, it should be readily apparent to those skilled in the art that the invention can be modified in arrangement and detail without departing from such principles.

While the descriptions herein contain many specificities, these should not be construed as limitations on the scope of the invention, but rather as exemplifications of several preferred embodiments thereof. Many other variations are possible, for example:

The main body 10 need not sit atop a pipe cap-fitting 60, but may be made to connect to a drain pipe 100 by other various means.

The installation collar 50 need not comprise the full circumference of the main body 10, but may be formed to allow the repositioning of only a portion of the circumference of the main body 10, or no portion at all.

The drain void 31 of the first embodiment may be made to encompass the outer left and outer right sections of the seepage barrier 30 in addition to the center section. This may be accomplished with or without the elimination of the barrier dividers 32L and 32R and barrier slots 49L and 49R.

To further reduce the height of the main body 10, the jacket furrows 16L and 16R and/or aperture fences 117L and 117R could be made to extend, by struts or by other means, into the pipe cap-fitting 60, or other means of pipe connection. Accordingly, the jacket rails 42L and 42R could be lengthened to extend below the faces of the sliding jacket 40. Such a configuration would relieve the requirement that the jacket rails 42L and 42R vertically clear the aperture 12 when the sliding jacket 40 is exposing the aperture.

Various means, other than the closing lobe 46, may be employed to reduce the interference of the diverter plate 20, in its stowed position, with the flow of water in the interior passage 11. One example would be by forming a deflecting surface inside the interior passage 11, above the aperture 12.

Accordingly, the scope of the invention should be determined not by the embodiments and ramifications described, but by the appended claims and their legal equivalents.

I claim:

1. A down-spout flow diverter for diverting water from a gutter system, through a down-spout, to a predetermined alternate location, the flow diverter comprising:

a main body defining an interior passage through which water, from a down-spout, flows to a primary location, the main body having an aperture disposed to define an outlet from which the water can be redirected from the interior passage to a predetermined alternate location;

a sliding jacket disposed for sliding engagement with the main body, the sliding jacket being movable from a first position covering the aperture, to a second adjacent position exposing the aperture to provide communication between the interior passage and the alternate location;

a diverter plate pivotally supported by the main body; the diverter plate disposed to pivot from a stowed position where the diverter plate is disengaged from the flow of water through the interior passage, to a diverting position where a portion of the diverter plate extends into the interior passage to divert the flow of water from the interior passage, through the outlet, to a predetermined alternate location; and wherein the diverter plate pivots from the stowed position to the diverting position responsive to the sliding jacket being moved from the first position covering the aperture, to the second position exposing the aperture.

2. A down-spout flow diverter as recited in claim 1 wherein the sliding jacket comprises an opening lobe that extends inward toward the interior passage, and the diverter plate comprises a concave groove disposed to receive the opening lobe when the sliding jacket is in the first position covering the aperture, wherein as the sliding jacket is moved from the first position covering the aperture, to the second position exposing the aperture, the opening lobe urges the diverter plate from the stowed position to the diverting position responsive to the opening lobe disengaging the concave groove.

3. A down-spout flow diverter as recited in claim 2 wherein the main body comprises a bi-curved groove disposed to engage and receive the opening lobe when the sliding jacket is moved from the first position covering the aperture, to the second adjacent position exposing the aperture, thereby maintaining the sliding jacket in the second position.

4. A down-spout flow diverter as recited in claim 3 wherein the main body further comprises a seepage barrier disposed outwardly offset from the aperture, extending upward from the base of the main body to define a drain void for channeling water seepage, that flows through the aperture from the interior passage when the diverter plate is in the stowed position, back to the interior passage.

5. A down-spout flow diverter as recited in claim 1 wherein the main body further comprises a seepage barrier disposed outwardly offset from the aperture, extending upward from the base of the main body to define a drain void for channeling water seepage, that flows through the aperture from the interior passage when the diverter plate is in the stowed position, back to the interior passage.

6. A down-spout flow diverter as recited in claim 5 further comprising an installation collar for connecting a down-spout to the main body, the installation collar being formed to slide over the outer surface of a down-spout for sliding movement from a disengaged position around the outer surface of a down-spout, to an engaged position connecting the down-spout to the main body so that water flowing through the down-spout is directed into the interior passage of the main body.

7. A down-spout flow diverter as recited in claim 1 further comprising an installation collar for connecting a down-spout to the main body, the installation collar being formed to slide over the outer surface of a down-spout for sliding movement from a disengaged position around the outer surface of a down-spout, to an engaged position connecting the down-spout to the main body so that water flowing through the down-spout is directed into the interior passage of the main body.

8. A down-spout flow diverter as recited in claim 1 wherein the diverter plate comprises opposing side surfaces extending between a lower edge and an upper edge of the diverter plate, the diverter plate further comprising at least one pivot axle extending outward from a side surface to pivotally engage the main body, the pivot axle being disposed between the upper edge of the diverter plate and the lower edge of the diverter plate so that as the diverter plate pivots from the stowed position to the diverting position, the lower edge of the diverter plate shifts outward, and the upper edge shifts inward into the interior passage.

9. A down-spout flow diverter as recited in claim 8 wherein the pivot axle is offset on the side surface.

10. A method of making a down-spout flow diverter for diverting water collected from a gutter system to a predetermined alternate location, the method comprising the steps:

forming a main body to define an interior passage through which collected water flows to a primary location, the main body having an aperture disposed to define an outlet from which collected water can be redirected from the interior passage to a predetermined alternate location;

providing a sliding jacket disposed for sliding engagement with the main body, the sliding jacket being movable from a first position covering the aperture, to a second adjacent position exposing the aperture to provide communication between the interior passage and the alternate location;

pivotally supporting a diverter plate from the main body; the diverter plate disposed to pivot from a stowed position where the diverter plate is disengaged from the flow of water through the interior passage, to a diverting position where a portion of the diverter plate extends into the interior passage to divert the flow of water from the interior passage, through the outlet, to a predetermined alternate location; and wherein the diverter plate is pivotal from the stowed position to the diverting position responsive to the sliding jacket being moved from the first position covering the aperture, to the second position exposing the aperture.

11. A method of making a down-spout flow diverter as recited in claim 10 wherein the sliding jacket is formed to define an opening lobe that extends inward toward the interior passage, and the diverter plate formed to define a concave groove disposed to receive the opening lobe when the sliding jacket is in the first position covering the aperture, wherein as the sliding jacket is moved from the first position covering the aperture, to the second position exposing the aperture, the opening lobe urges the diverter plate from the stowed position to the diverting position responsive to the opening lobe disengaging the concave groove.

12. A method of making a down-spout flow diverter as recited in claim 11 wherein the main body is formed to define a bi-curved groove disposed to engage and receive the opening lobe when the sliding jacket is moved from the first position covering the aperture, to the second adjacent position exposing the aperture, thereby maintaining the sliding jacket in the second position.

13. A method of making a down-spout flow diverter as recited in claim 12 wherein the main body is formed to further comprise a seepage barrier disposed outwardly offset from the aperture, extending upward from the base of the main body to define a drain void for channeling water seepage, that flows through the aperture from the interior passage when the diverter plate is in the stowed position, back to the interior passage.

14. A method of making a down-spout flow diverter as recited in claim 10 wherein the main body is formed to further comprise a seepage barrier disposed outwardly offset from the aperture, extending upward from the base of the main body to define a drain void for channeling water seepage, that flows through the aperture from the interior passage when the diverter plate is in the stowed position, back to the interior passage.

15. A down-spout flow diverter for diverting water from a gutter system, through a down-spout, to a predetermined alternate location, the flow diverter comprising:

a main body defining an interior passage through which water, from a down-spout, flows to a primary location, the main body having an aperture disposed to define an outlet from which the water can be redirected from the interior passage to a predetermined alternate location;

a sliding jacket disposed for sliding engagement with the main body, the sliding jacket being movable from a first position covering the aperture, to a second adjacent position exposing the aperture to provide communication between the interior passage and the alternate location;

a diverter plate pivotally supported by the main body; the diverter plate disposed to pivot from a stowed position where the diverter plate is disengaged from the flow of water through the interior passage, to a diverting position where a portion of the diverter plate extends into the interior passage to divert the flow of water from the interior passage, through the outlet, to a predetermined alternate location;

wherein the diverter plate pivots from the stowed position to the diverting position responsive to the sliding jacket being moved from the first position covering the aperture, to the second position exposing the aperture; and wherein the sliding jacket comprises an opening lobe that extends inward toward the interior passage, and the diverter plate comprises a concave groove disposed to receive the opening lobe when the sliding jacket is in the first position covering the aperture, wherein as the sliding jacket is moved from the first position covering the aperture, to the second position exposing the aperture, the opening lobe urges the diverter plate from the stowed position to the diverting position responsive to the opening lobe disengaging the concave groove.

16. A down-spout flow diverter as recited in claim 15 wherein the main body further comprises a seepage barrier disposed outwardly offset from the aperture, extending upward from the base of the main body to define a drain void for channeling water seepage, that flows through the aperture from the interior passage when the diverter plate is in the stowed position, back to the interior passage.

17. A down-spout flow diverter as recited in claim 16 further comprising an installation collar for connecting a down-spout to the main body, the installation collar being formed to slide over the outer surface of a down-spout for sliding movement from a disengaged position around the outer surface of a down-spout, to an engaged position connecting the down-spout to the main body so that water flowing through the down-spout is directed into the interior passage of the main body.

18. A down-spout flow diverter as recited in claim 15 further comprising an installation collar for connecting a down-spout to the main body, the installation collar being formed to slide over the outer surface of a down-spout for sliding movement from a disengaged position around the outer surface of a down-spout, to an engaged position connecting the down-spout to the main body so that water flowing through the down-spout is directed into the interior passage of the main body.

19. A down-spout flow diverter as recited in claim 15 wherein the main body comprises a bi-curved groove disposed to engage and receive the opening lobe when the sliding jacket is moved from the first position covering the aperture, to the second adjacent position exposing the aperture, thereby maintaining the sliding jacket in the second position.

20. A down-spout flow diverter as recited in claim 19 wherein the main body further comprises a seepage barrier disposed outwardly offset from the aperture, extending upward from the base of the main body to define a drain void for channeling water seepage, that flows through the aperture from the interior passage when the diverter plate is in the stowed position, back to the interior passage.

* * * * *